US006925923B2

(12) United States Patent
Harrison

(10) Patent No.: US 6,925,923 B2
(45) Date of Patent: Aug. 9, 2005

(54) ROTARY CUTTING DIE MOUNTING SYSTEM

(75) Inventor: Frederick W. Harrison, Richland, MI (US)

(73) Assignee: Hycorr Machine Corporation, Kalamazoo, MI (US)

( * ) Notice: Subject to any disclaimer, the term of this patent is extended or adjusted under 35 U.S.C. 154(b) by 16 days.

(21) Appl. No.: 10/264,158

(22) Filed: Oct. 3, 2002

(65) Prior Publication Data

US 2003/0066405 A1 Apr. 10, 2003

Related U.S. Application Data

(60) Provisional application No. 60/327,503, filed on Oct. 5, 2001.

(51) Int. Cl.[7] ..... B26D 1/62

(52) U.S. Cl. ..... 83/698.41; 83/331; 83/665

(58) Field of Search ..... 83/698.42, 331, 83/665, 452, 459, 461, 462, 481, 482, 375, 390, 567, 460, 698.41, 698.51; 76/107.8; 101/36, 91, 224; 492/28–38; 92/49, 53, 190, 191

(56) References Cited

U.S. PATENT DOCUMENTS

| | | | | |
|---|---|---|---|---|
| 2,302,855 A | | 11/1942 | Hallman | |
| 3,073,198 A | | 1/1963 | Clem | |
| 3,752,021 A | * | 8/1973 | Klien et al. | 409/304 |
| 3,752,042 A | | 8/1973 | Castille | |
| 4,257,298 A | * | 3/1981 | Aykut | 83/482 |
| 4,561,355 A | * | 12/1985 | Cuir et al. | 101/378 |
| 4,815,343 A | | 3/1989 | Sofinowski | |
| 4,844,429 A | * | 7/1989 | Ecktman | 267/64.24 |
| 4,854,555 A | * | 8/1989 | Ohkawa et al. | 267/64.24 |
| 4,878,407 A | | 11/1989 | Harrison et al. | |
| 4,914,936 A | * | 4/1990 | Lavorel | 72/345 |
| 5,003,854 A | | 4/1991 | Capdebosco | |
| 5,230,271 A | | 7/1993 | Hardisty et al. | |
| 5,638,733 A | | 6/1997 | Brazzo | |
| 5,875,699 A | | 3/1999 | Koelsch | |
| 6,109,158 A | | 8/2000 | Koelsch | |

FOREIGN PATENT DOCUMENTS

| | | |
|---|---|---|
| EP | 0 124 329 | 11/1984 |
| EP | 1 008 425 | 6/2000 |
| WO | WO 96/26049 | 8/1996 |

* cited by examiner

*Primary Examiner*—Allan N. Shoap
*Assistant Examiner*—Phong Nguyen
(74) *Attorney, Agent, or Firm*—Flynn, Thiel, Boutell & Tanis, P.C.

(57) ABSTRACT

A clamping mechanism for securing a cutting die board to a rotary support cylinder, including a double-acting pressure cylinder having a piston rod coupled to a clamping bolt which cooperates with a keyhole-shaped slot formed through the cutting die board, and an arrangement for supplying low pressure air to an extension chamber defined on one side of the pressure cylinder piston for controlling the magnitude of force applied to the bolt during extension thereof. In an alternate embodiment, a low-force releasable slip coupling connects between the piston rod and the bolt to control the extension force applied to the bolt.

10 Claims, 14 Drawing Sheets

FIG. 5 (PRIOR ART)

ROTARY CUTTING DIE MOUNTING SYSTEM

CROSS REFERENCE TO RELATED APPLICATION

This application claims priority under 35 USC §119(e) of copending provisional application Ser. No. 60/327 503 filed Oct. 5, 2001, the entire disclosure of which is herein incorporated by reference.

FIELD OF THE INVENTION

This invention relates to a securing structure for permitting rapid mounting and demounting of a cutting die onto a rotary cylinder of a machine for cutting laminar material such as corrugated cardboard, and the associated mounting process.

BACKGROUND OF THE INVENTION

The mounting of a cutting die board or cutting die onto the rotary cylinder of a cutting machine has frequently utilized a plurality of threaded fasteners such as screws which must be manually manipulated in order to provide secure connection of the die board to the cylinder, particularly due to centrifugal forces which are generated during operation of the machine and which tend to effect separation of the board from the support cylinder. In an attempt to expedite the mounting or interchanging of the die cutting boards, attempts have been made to utilize securing devices involving magnetic systems or vacuum forces, but the disadvantage of such systems is their inability to provide a positive and secure mechanical connection between the support cylinder and the die cutting board. Quick release securing devices employing mechanical springs have also been developed, but such devices typically require springs which must have the capability of generating the requisite forces necessary to hold the die board in position in opposition to the rotational-generated centrifugal forces, and high pressure cylinders for releasing the board. These overall devices have involved undesired mechanical complexity.

It is an object of this invention to provide an improved and mechanically and operationally simplified securing device for permitting rapid fixing or attaching of the cutting die board onto the machine support, such as the rotary cylinder, and which is capable of providing a secure mechanical connection of the board to the support during the normal rotational operation of the machine.

With the improved securing arrangement of the present invention, according to one embodiment thereof, a securing bolt which engages the cutting board is coupled to a double-acting fluid pressure cylinder which is mounted on the support. The fluid pressure cylinder is selectively supplied with high pressure against one side thereof which draws the bolt inwardly into securing engagement with the board, or when mounting or demounting of the board is desired draws the bolt inwardly so that the head thereof is substantially flush with the support. As part of the mounting or demounting process, however, the high pressure is exhausted from the cylinder, and low pressure is applied to the other side of the cylinder to cause the bolt head to move outwardly through an access opening formed in the mounting board. The force generated by this low pressure cylinder, however, is such that if the bolt head does not align with an access opening in the board, then the force exerted by the bolt against the board is not sufficient to effect separation or movement thereof.

According to an alternate embodiment of the present invention, the improved securing arrangement again has a clamping bolt for engaging the cutting board, which securing bolt is coupled to the piston rod of a double-acting fluid pressure cylinder through a slip coupling which permits relative longitudinal movement when the longitudinal force transmitted therethrough exceeds a small controlled magnitude. A pressure fluid can be supplied to opposite sides of the piston for controlling extension and retraction of the bolt. However, if the clamping bolt during extension does not align with a hole in the die cutting plate, then the force applied thereto by the die cutting plate causes the slip coupling to release and allows the piston rod to extend even though the clamping bolt does not, thereby preventing excessive separation force from being applied to the die cutting plate.

Other objects of the invention will be apparent upon reading the following specification and inspecting the accompanying drawings.

Figure 2:
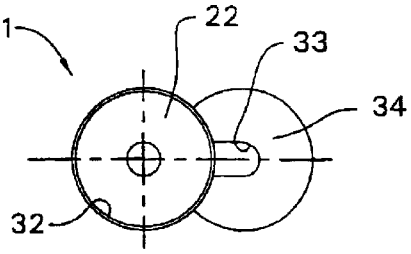
FIG. 2 is a top view which shows solely the upper end of the securing bolt and its cooperation with the opening arrangement formed in the cutting die board.

Certain terminology will be used in the following description for convenience in reference only, and will not be limiting. For example, the words "upwardly", "downwardly", "rightwardly" and "leftwardly" will refer to directions in the drawings to which reference is made. The words "extend" and "retract" will refer to movement directions associated with the clamping bolt relative to the activating device which controls the bolt movement. The words "inwardly" and "outwardly" will refer to directions toward and away from, respectively, the geometric center of the device and designated parts thereof. Said terminology will include the words specifically mentioned, derivatives thereof, and words of similar import.

DETAILED DESCRIPTION

Figure 1:
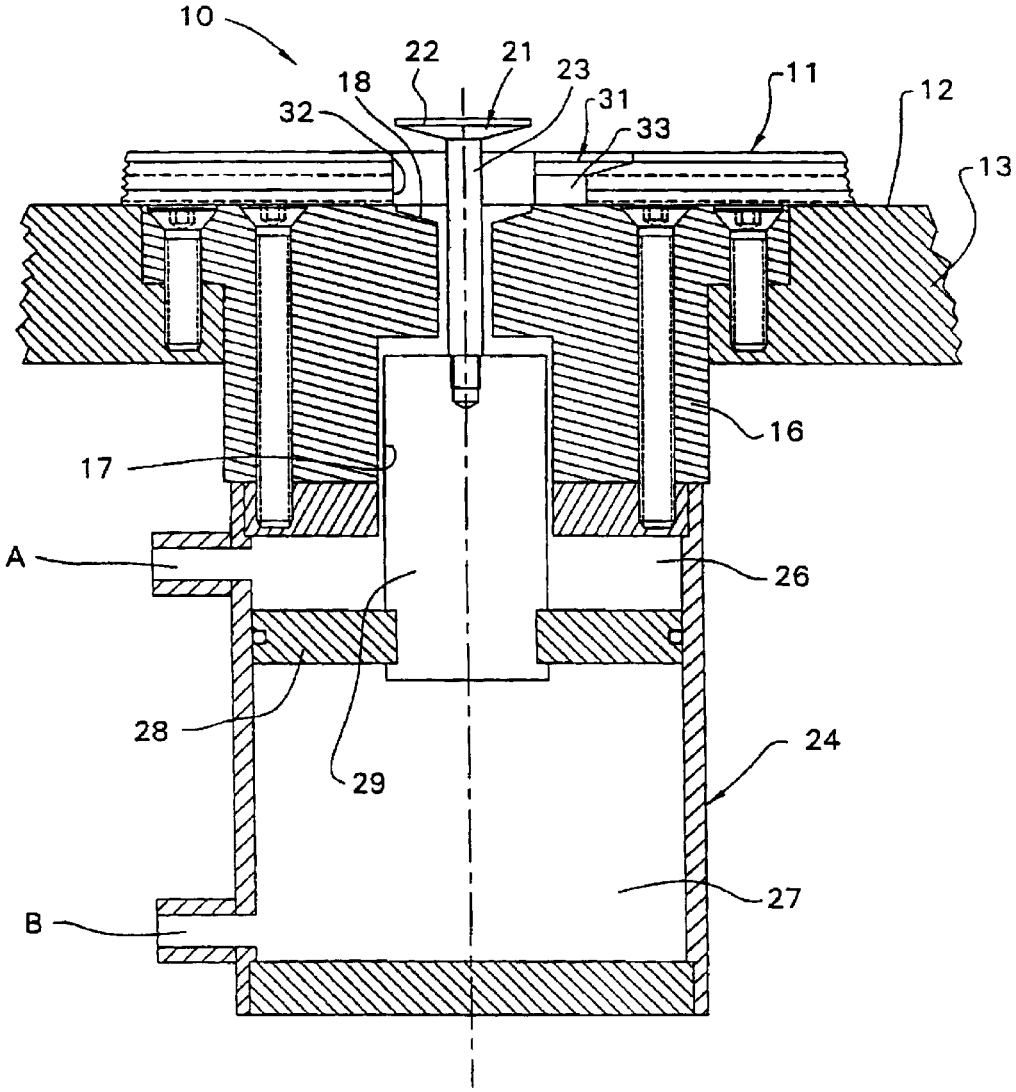
FIG. 1 is a fragmentary sectional view showing an embodiment of a securing device of the present invention as mounted on a rotatable support and cooperating with a cutting die board, with the securing device being shown in its released position.

Referring to FIG. 1 there is illustrated a clamping or securing mechanism 10 for providing rapid but fixed securement of a die cutting board 11 to the peripheral wall 12 of a rotary support cylinder 13 (FIG. 5) associated with a cutting machine. In FIG. 1 the cutting die board 11 is shown in its initial position in contact with the support cylinder wall 12, but the securing mechanism 10 is shown in its released position.

The securing mechanism 10, with respect to its overall configuration, includes a clamping bolt 21 which is attached to and activated by a double-acting fluid pressure cylinder 24, preferably a pneumatic cylinder. The clamping bolt 21 is positioned for cooperation with one of a plurality of similarly oriented elongated openings or apertures 31 which are formed in and extend through the board 11.

The clamping bolt 21 includes an enlarged head 22 at the outer end thereof, the latter typically being of cylindrical configuration, and this head 22 is fixedly and coaxially joined to an elongate rodlike shank 23 which is of significantly smaller diameter than the head 22. The shank 23 at its other end is coaxially fixed to the free end of a piston rod 29 associated with the pneumatic cylinder 24. This latter cylinder is double acting and includes pressure chambers 26 and 27 defined on opposite sides of the slidable piston 28, and the housing of the cylinder has ports A and B associated therewith for communication with the respective chambers 26 and 27.

The cylinder 24, in the illustrated embodiment as exemplary, is secured to a mounting sleeve 16 which is mounted within an opening associated with the support wall 12 and is fixed thereto by appropriate fasteners. The support sleeve 16 has a stepped bore 17 extending centrally therethrough in alignment with the cylinder so as to accommodate the piston rod 29 and the bolt shank 23, and the outer end of this bore is provided with an enlarged recess 18 configured similar to the underside of the bolt head 22 so as to permit the bolt head to be accommodated therein in a disposition substantially flush with the outer surface of the support wall 12.

Figure 3:
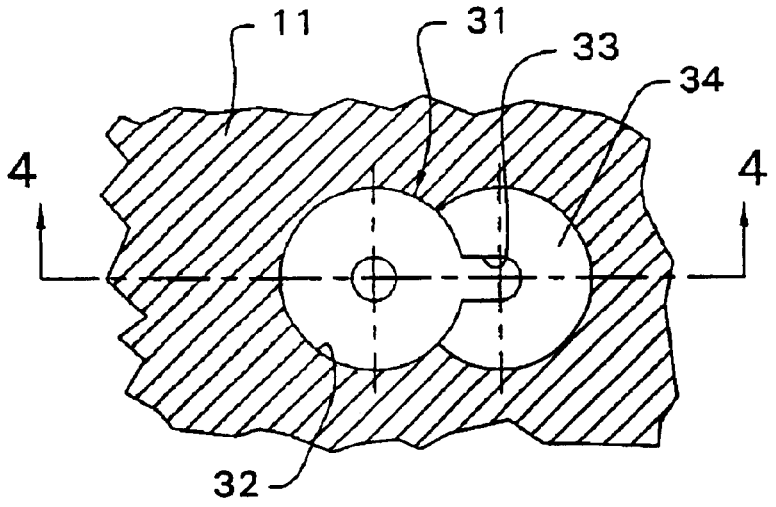
FIG. 3 is an enlarged fragmentary top view of the cutting die board and showing the opening associated therewith.
Figure 4:
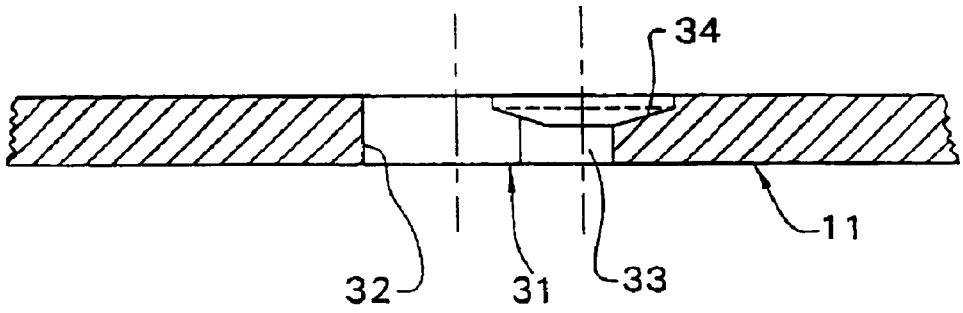
FIG. 4 is a fragmentary sectional view taken along line 4—4 in FIG. 3.

Reference is now made to FIGS. 3 and 4 which illustrate one of a plurality of elongated openings or apertures 31 associated with the cutting die board 11. Each elongate aperture (32?) has, at one end thereof, an enlarged opening 32 which, in the illustrated embodiment, is a generally cylindrical opening which extends transversely through the die board 11 and has a cross section or diameter which is preferably at least slightly larger than the cross section of the bolt head 22 so as to permit the bolt head 22 to pass freely therethrough. The elongate opening 31 also has an elongate narrow slot 33 which projects transversely away from one side of the end opening 32 through a distance which is preferably at least similar in magnitude to the radius of the end opening 32. The slot 33 is of narrow width relative to the diameter of end opening 32, and in fact the width of slot 33 is selected so as to be only slightly larger than the diameter of the bolt shank 23 so that the latter can be accommodated therein. The closed or blind end of the slot 33 is provided with a rounded or generally semicylindrical concave wall so as to accommodate the bolt shank 23 therein. This slot 33 extends transversely throughout the thickness of the die board 11 so that the end opening 32 and narrow slot 33, when viewed from the exposed surface of the board, define a generally keyhole-shaped opening or aperture.

The opening or aperture 31, as illustrated in FIGS. 3–4, is also preferably provided with a shallow recess 34 which opens inwardly from the exposed outer surface of the die board 11 and is effectively centered about a point located adjacent the blind end of the slot 33. This shallow recess 34 typically is shaped or configured so that the bottom wall thereof substantially matches the profile on the bottom of the bolt head 22 when the shank 23 is positioned at the blind end of the narrow slot 33. The bottom of the bolt head 22, which typically is a truncated conical bottom surface, hence engages the similar conical surface defined by the recess 34 so as to permit the bolt head to be clampingly engaged against the die board 11 in a position such that the exposed upper surface of the bolt head 22 is substantially flush with the upper surface of the die board. The engagement-disengagement of the die board relative to the support 12 hence requires movement of the die board along the surface of the support 12 in the elongate direction of the opening or aperture 31, which direction may be aligned parallel to the rotational axis of the support cylinder, perpendicular to the rotational axis of the support cylinder, or in some other selected direction. Orienting the elongated direction of the apertures, and hence the engagement-disengagement movement direction of the board, perpendicular to the rotational axis of the support cylinder is preferred, and such is diagrammatically illustrated in FIG. 5. In this orientation the board 11 and support 12 will have an arcuate shape, but they are shown flat in the drawings for convenience in illustration.

Figure 5:
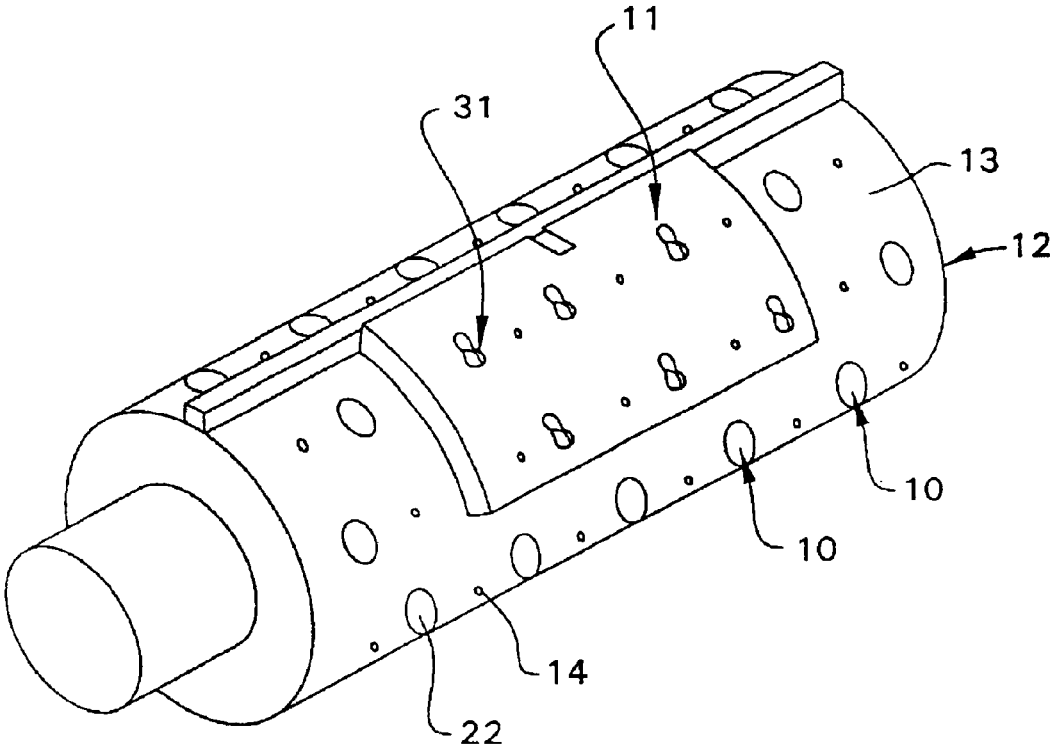
FIG. 5 is a perspective view of a conventional rotary cylinder or support associated with a die cutting machine and having a single cutting die board mounted thereon for purposes of illustration. It will be appreciated that the support cylinder may have several cutting die boards mounted at various locations thereon.

The support cylinder 13 as shown in FIG. 5 has a plurality of clamping mechanisms 10 mounted thereon and arranged in a pattern both around and across the face of the support cylinder. A plurality of tapped mounting holes 14 may also be provided in the wall 12 of the support cylinder 13, with these tapped mounting holes 14 being placed in a pattern around and across the cylinder so as to not interfere with the operation of the clamping mechanisms 10. The die board 11 has a plurality of similarly-oriented elongate openings or apertures 31 formed therein and extending therethrough, which apertures are arranged in a pattern so as to match the pattern of the clamping mechanisms 10. It should be noted that an aperture 31 will not necessarily be provided for every clamping mechanism 10 since it may be necessary to locate a cutting rule over a clamping mechanism location.

Figure 6:
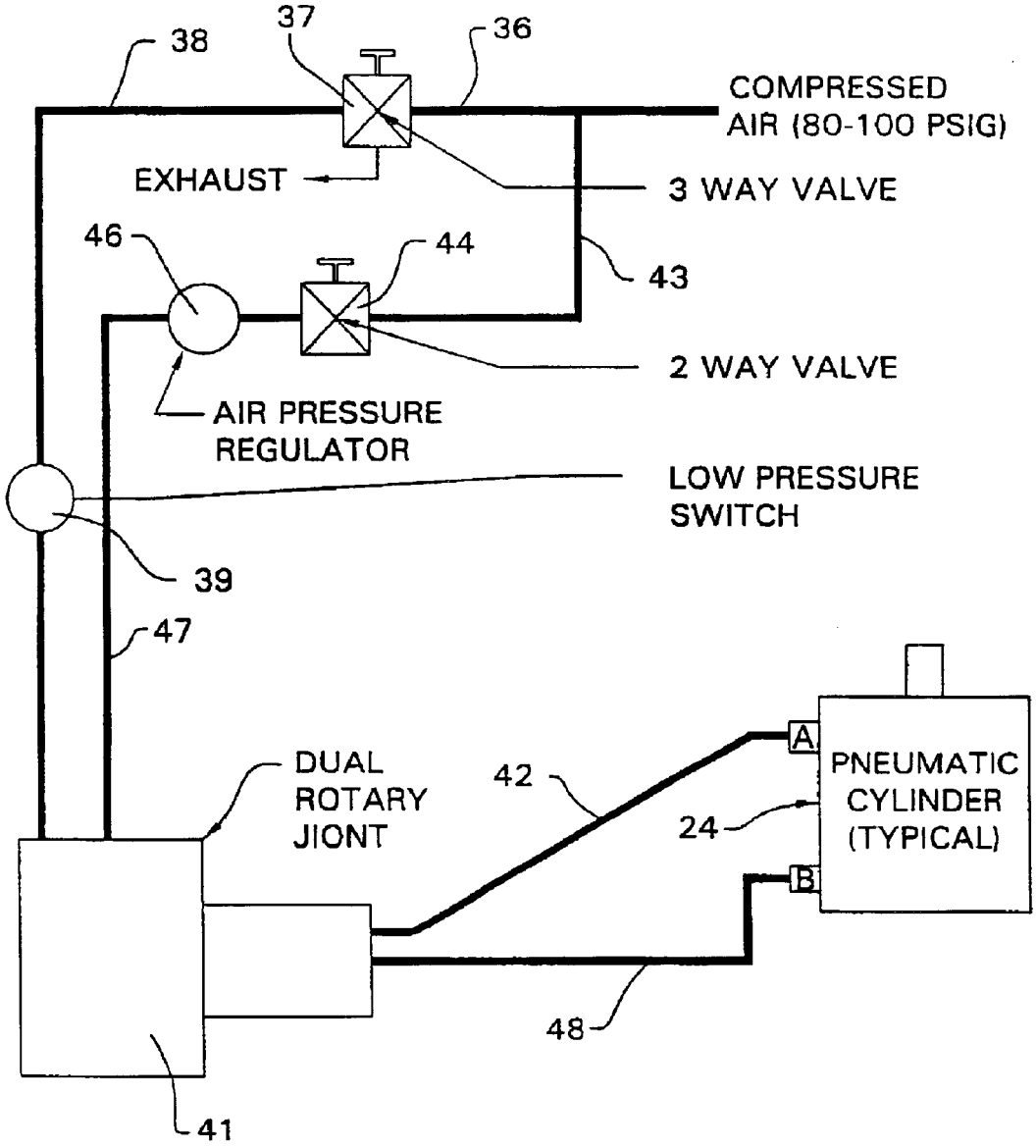
FIG. 6 illustrates, as an example, a fluid pressure control system for controlling the pressure cylinder associated with the securing device according to the present invention.

Referring now to FIG. 6, there is diagrammatically illustrated one example of a control circuit arrangement for controlling the pressure fluid, namely pressurized air, as supplied to the double-acting pressure cylinders 24 associated with the plurality of clamping mechanisms 10 so as to permit simultaneous control and actuation of these mechanisms. The following description may relate to control of only a single mechanism, but it will be appreciated that all of the mechanisms 10 associated with the cylinder 13 or pluralities of such mechanisms as associated with different spacial zones of the cylinder, can be simultaneously coupled and hence controlled and activated from the control system.

More specifically, pressurized air is supplied to a main supply line 36, which air may comprise the typical pressurized system air which is available in most manufacturing facilities. This main supply line 36 supplies high pressure air to a main control valve 37, typically a three-way valve. This valve 37, in what may be referred to as an open position, permits high pressure air to be supplied into the line 38, and hence the exhaust from valve 37 is closed off. When valve 37 is in the closed position, however, then line 38 couples to the exhaust. The line 38 has a low pressure switch 39 associated therewith, as described hereinafter, and the line 38 in turn supplies high pressure air to a first port of a conventional rotary joint 41 which is mounted on the rotating journal of the cutting die support cylinder 13. This rotary joint 41 in turn has an output port which is in communication with the supply line 38, and this output port couples to the line or passage 42 which in turn couples to the port A associated with the pneumatic cylinders 24 associated with the clamping mechanisms 10. Hence, when valve 37 is in the open position so as to supply high pressure air to the line 38, such high pressure air is hence supplied to the pressure chambers 26 associated with the clamping devices 10 so as to tend to retract the clamping bolts 21 inwardly (downwardly in FIG. 1) toward the support 12. When the valve 37 is in its closed position, however, then line 38 is connected to the exhaust associated with the valve, and hence the chambers 26 are depressurized.

The low pressure switch 39 is provided so as to function as a safety interlock to prevent or stop rotation of the cylinder 13 in the event of unacceptable pressure loss in the air system. For example, the high pressure air supplied to line 38 and to the cylinder chambers 26 is effective for retracting the clamping bolts inwardly to hence securely hold or clamp the board 11 against the wall 12 of the support cylinder 13 and to hold it in this position during rotation of the latter. If the magnitude of the pressure in line 38 falls below a minimum amount, however, then inadequate holding force may exist, and hence the pressure switch 39 senses the pressure and, upon pressure falling below a minimum amount, causes stoppage of the rotary cylinder 13.

The main supply line 36 connects to a branch line 43 which supplies high pressure air to a control valve 44, which may be a conventional 2-way valve, i.e. a simple on-off valve. This valve 44, when in an open position, permits the high pressure air to be supplied to a supply line 47 which contains therein a pressure regulator 46, the latter in a conventional manner effecting a significant pressure reduction so that the pressurized air within the line 47 downstream of regulator 46 is hence at a pressure magnitude which is substantially less than the pressure magnitude of the air upstream of the regulator 46. The reduced air pressure in the line 47 downstream of regulator 46 is supplied to a second port associated with the rotary joint 41, which in turn supplies the low pressure air to a further rotary output thereof which in turn couples to a line or passage 48 which supplies the low pressure air to the pressure chamber 27 of each of the coupled clamping devices 10 associated with the rotary cylinder.

In a typical and preferred operation, high pressure air is supplied to the retracting chambers 26 and low pressure air is supplied to the extending chambers 27. The pressure of the air supplied to chamber 26 will typically be many times greater, such as typically at least an order of magnitude (i.e. 10 times) greater, than the pressure of the air supplied to the extending chamber 27. For example, the pressurized air supplied from line 36 to line 38, and hence to retracting chamber 26, will typically be in the range of about 80 psi to about 100 psi, such being typical pressure levels for air in most manufacturing operations. On the other hand, the pressure of the air supplied to the extending chamber 27, due to passage of the air through the pressure regulator 46, will typically be less than about 10 psi, and more preferably a maximum of about 5 psi.

The operational sequence for mounting a cutting die board 11 on an empty die support cylinder 13 will now be briefly described.

The valve 37 will be opened so that high pressure air will be supplied through lines 38 and 42 to the retracting chambers 26 of the cylinders, thereby drawing the bolts 21 inwardly so that the heads 22 are effectively seated within the recesses 18 and are thus substantially flush with the surface of the support 12. The cutting board 11 is then positioned on the support cylinder so that the holes 31 are generally aligned over the bolt heads 22. The three-way valve 37 is then moved back to its closed or opposite position to isolate the main supply line 36, and connect the line 38 to exhaust to thereby exhaust the high pressure air from the retraction chambers 26. Low pressure air can then be supplied to the extension chamber 27, such as by opening the valve 44 so that low pressure air is supplied to the chamber 27 and hence tends to move the piston 28 outwardly (upwardly in FIG. 1) to effect outward extension of the bolt 21. The low pressure supplied to the extension chamber 27, coupled with the overall size of the piston as well as the weight of the piston and its connected piston rod and bolt assembly, is selected so as to provide a minimal extension force necessary so as to overcome the weight of the assembly and hence effect outward movement or extension thereof. This outward movement due to supplying low pressure air to chambers 27 causes the bolts 21 to move outwardly and hence extend through the aligned holes 32 in the cutting board until the bolt heads 22 are in a fully extended position disposed adjacent but above the upper surface of the die board 11. In the situation where no hole 32 exists in the die board 11 above one of the bolts 21, or the hole 32 is not properly aligned with the bolt, then that bolt does not move outwardly and the low pressure supplied to the respective chamber 27 and hence the extending force imposed on the bolt is incapable of separating or pushing the cutting die board 11 away from the support cylinder 13 since the latter can still be held in engagement with the surface of the support cylinder, such as by application of minimal manual pressure. After the bolts 21 have been extended through the apertures 31 in the die board, then the die board 11 is laterally moved or shifted relative to the support cylinder 13 in the elongated direction of the apertures 31, which movement in a preferred embodiment is circumferentially of the cylinder as illustrated in FIG. 5. This lateral shifting of the board causes the bolt shanks 23 (FIG. 1) to move into and be positioned adjacent the closed ends of the narrow slots 33 substantially in contact with the end walls thereof. The valve 37 is then again activated into its other or open position so that high pressure air is again supplied to the retracting chambers 26 of the pressure cylinders. This hence causes the pistons and the bolts to retract downwardly so that the bolt heads 22 move into and contact the bottom walls of the recesses 34 formed in the die board 11 to hence effect secure holding and clamping of the die board 11 against the peripheral surface of the support cylinder 13. The high pressure supplied to the chambers 26 is continually maintained during the rotational operation of the cylinder 13 so as to securely hold the die boards 11 in clamping engagement with the cylinder.

Since the low pressure supplied to the extension chamber 27 is only of small magnitude relative to the high pressure supplied to the retraction chamber 26, the pressure supplied to chamber 26 may be maintained at all times, provided that the supply passage 48 is provided with a pressure relief valve so as to permit escape of excess air when the piston moves downwardly due to the supply of high pressure air to the upper chamber 26. Maintaining a constant low pressure in the extension or lower chamber 27 does not interfere with the overall operation since the significantly higher pressure supplied to upper chamber 26 is easily able to overcome the minimal oppositely-directed force generated by the low pressure in the lower chamber 27.

Alternately, the low pressure supplied to lower chamber 27 can be supplied and exhausted by providing the line 47, downstream of the regulator 46, with an appropriate three-way valve which would be capable of functioning in a manner similar to valve 37 to hence permit the low pressure air to exhaust whenever the upper chamber 26 is pressurized.

The operational sequence for removing a cutting die board 11 from the die support cylinder 13 will now be briefly described.

Since high pressure fluid is continuously supplied to the retracting chamber 26 when the board is mounted on the cylinder, the valve 37 is moved to the opposite or closed position so that high pressure fluid is exhausted from chamber 26 through the exhaust port associated with valve 37. Low pressure air existing in or supplied to the extension chamber 27 then effects outward extension of the clamping bolts 21 away from the recesses 34. The die board 11 is then moved or shifted laterally relative to the surface of the support cylinder so that the raised bolt heads 22 effectively align with the enlarged end openings 32. Valve 37 is then again shifted so as to cause high pressure air to be supplied to line 38 and hence into the retracting chambers 26, causing the bolts 21 to retract downwardly through the openings 32 until the bolt heads 22 seat within the recesses 18 substantially flush with the outer surface of the support cylinder 13. The board 11 is hence now totally disconnected from the support cylinder and can be removed.

Figure 7:
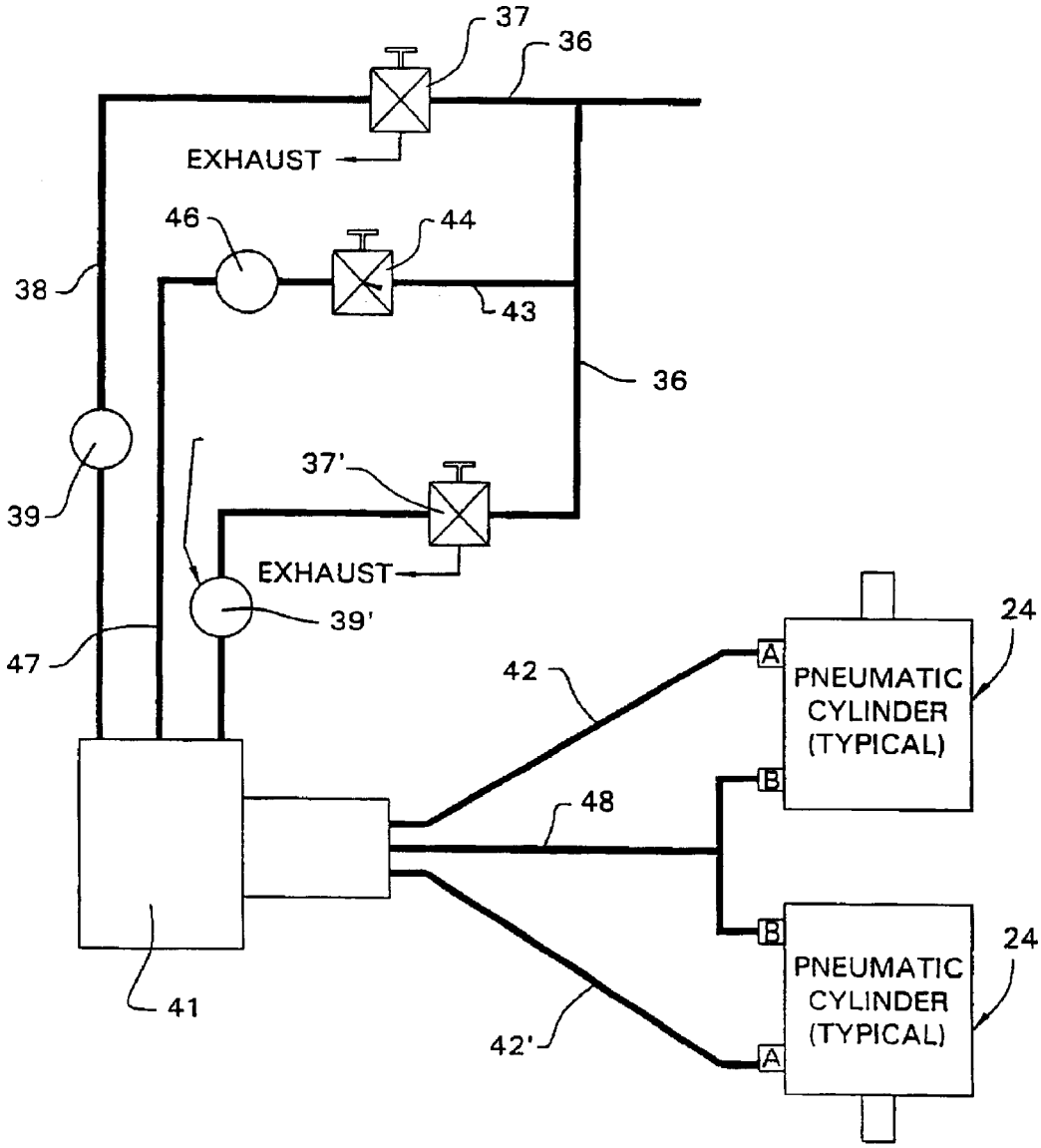
FIG. 7 illustrates a modification of the fluid pressure control system of FIG. 6.

While the control arrangement of FIG. 6 diagrammatically illustrates how one or multiple cutting dies can be secured to the cylinder, this arrangement will typically be used to cover a maximum of 180° around the periphery of the cylinder. Since die plates will typically be attached to the cylinder so as to extend over an angular extent greater than 180°, typically using two die plates, then in such instance the control system will be configured so as to permit each die plate to be individually controlled, and a suitable arrangement for such purpose is illustrated in FIG. 7. The overall control arrangement of FIG. 7 identically corresponds to that of FIG. 6 except that the rotary joint provides control over separate fluid pressure cylinders each controlling its respective securing device, and the two securing device cylinders acting through the rotary joint are individually controlled by their own valves 37, 37' and low pressure switches 39, 39'. In all other respects, however, the arrangement of FIG. 7 structurally and functionally corresponds to the arrangement illustrated in FIG. 6.

While FIGS. 6 and 7 diagrammatically illustrates only one example of a control system for regulating and controlling the flow of high and low pressure air to the double-acting cylinders, it will be appreciated that numerous other conventional circuits and fluid control devices can be utilized for accomplishing this same purpose. In addition, appropriate mechanical and/or electrical controls can also be provided so as to permit the overall control of the valves and related control devices to be operated from a remote location through use of an appropriate control board or panel.

With the overall clamping mechanism 10 of the present invention, the overall structure is relatively simple to manufacture, assemble and operate, and in particular is free of mechanical springs. Total control over the movement of the clamping bolts is thus provided solely by the double-acting cylinder, with significantly different extension and retraction (and holding) forces being achieved by use of a small but compact double-acting cylinder subjected to significantly different pressure magnitudes which act on opposite sides of the respective piston. More specifically, the inventive clamping mechanism desirably provides a high force for retracting the bolts and clamping (i.e. holding) the die board, and provides a much smaller force for extending the bolts during mounting and demounting operations, with the clamping force typically being ten or more times greater than the extension force.

Figure 8:
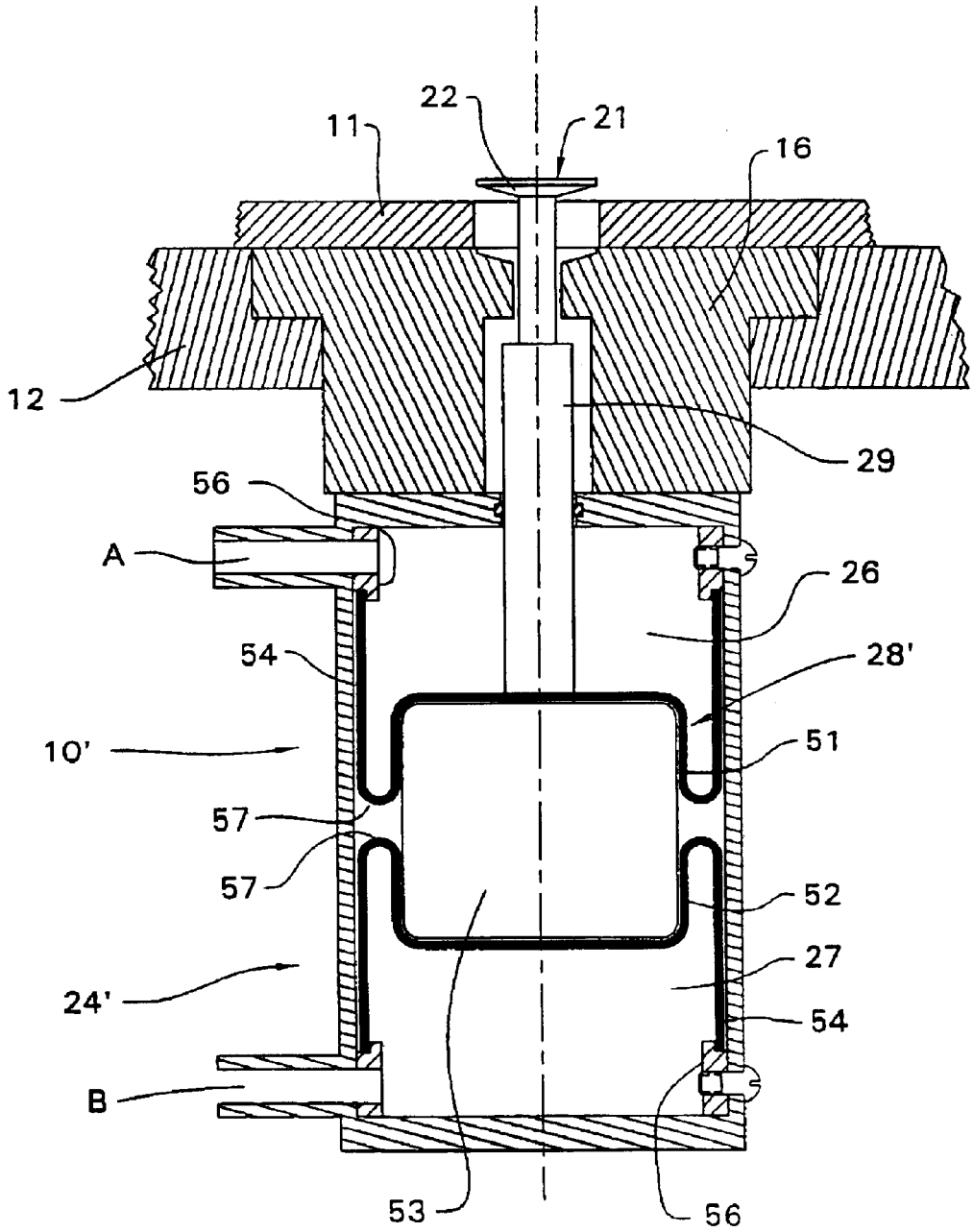
FIG. 8 is a fragmentary sectional view similar to FIG. 1 but illustrating an alternate embodiment of the securing device.

FIG. 8 illustrates a cross-sectional view of a variation of the securing device depicted in FIG. 1. The variation illustrated in FIG. 8 generally corresponds to the FIG. 1 embodiment and corresponding parts thereof are designated by the same reference numerals. In the FIG. 8 variation, however, the sliding piston of the FIG. 1 embodiment has been replaced by a flexible membrane or bellows type piston. More specifically, the piston rod 29 interiorly of the double acting pressure cylinder is coupled to a piston arrangement 28' which again effects separation between the chambers 26 and 27. The piston arrangement 28' in this embodiment, however, is defined by a pair of rolling diaphragms or bellows 51 and 52 which have the centers thereof fixedly and sealingly secured to a hub 53 which is defined on the piston rod 29. Each of the diaphragms 51 and 52 has an outer peripheral portion 54 thereof sealingly fixed relative to the outer wall of the cylinder housing, such as by a clamping sleeve 56. Each of the diaphragms or bellows 51–52 hence has an intermediate annular portion 57 which, in response to application of pressure fluid thereon within the respective chamber 26 or 27, can cause the diaphragm to effectively longitudinally roll in a conventional manner within the cylinder housing so as to effect a corresponding longitudinal displacement of the piston rod 29.

With the membrane-type piston arrangement 28' of this embodiment, sliding contact between the piston and cylinder housing is eliminated, and accordingly a much smaller pressure force can be utilized to effect rolling movement of the diaphragms and corresponding displacement of the piston rod 29 since the pressure generated in the pressure chamber does not have to overcome the breakaway friction which typically occurs between a cylinder wall and a sliding piston.

The operation of the FIG. 8 embodiment, except for the desired ability to effect operation of the device while permitting supply of a lower pressure fluid to the bottom chamber 27, is in all other respects generally the same as the operation of the FIG. 1 embodiment as described above.

Figure 9:
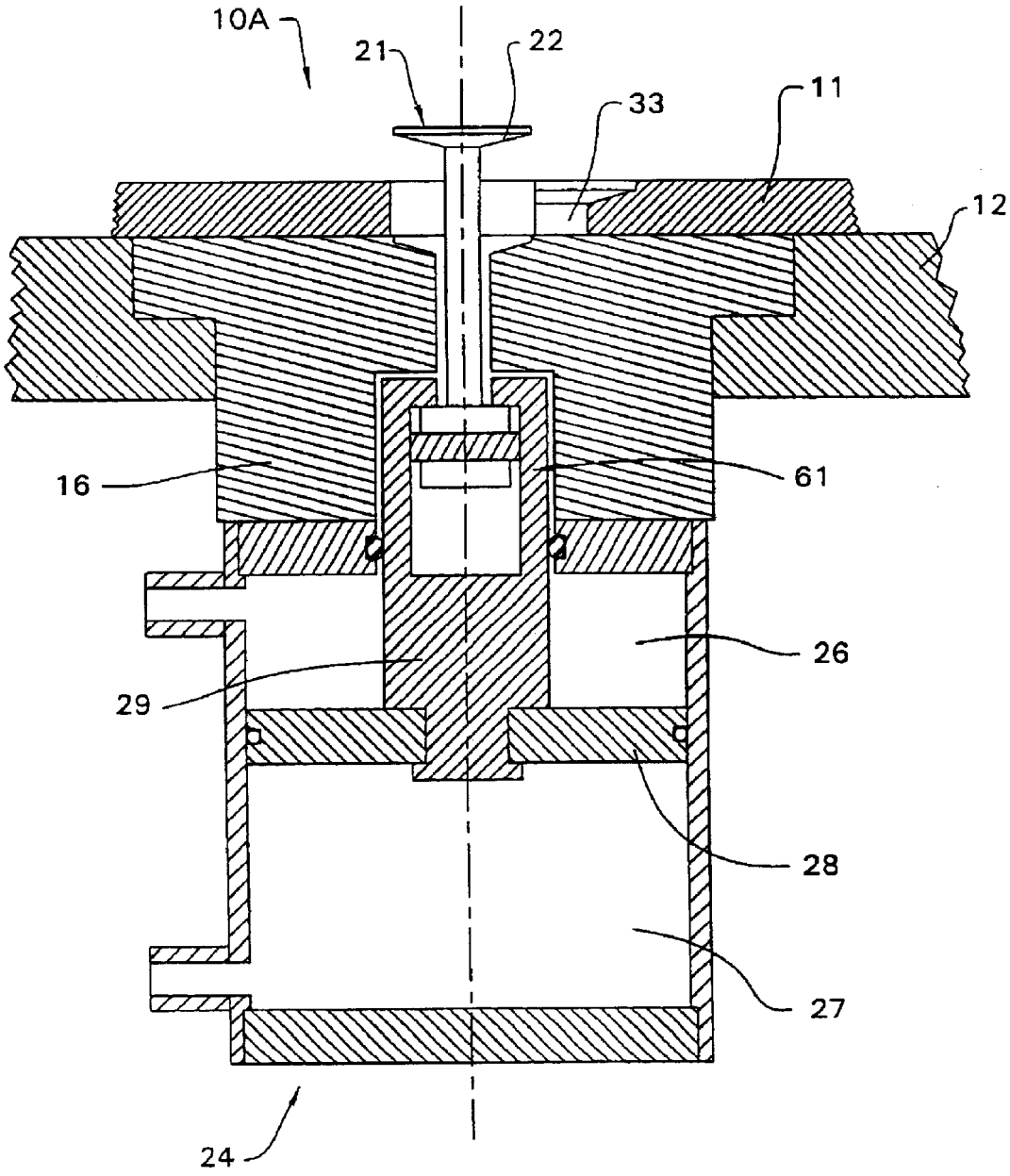
FIG. 9 is a fragmentary sectional view illustrating a further variation of the securing device incorporating therein a low-force release slip coupling.
Figure 10:
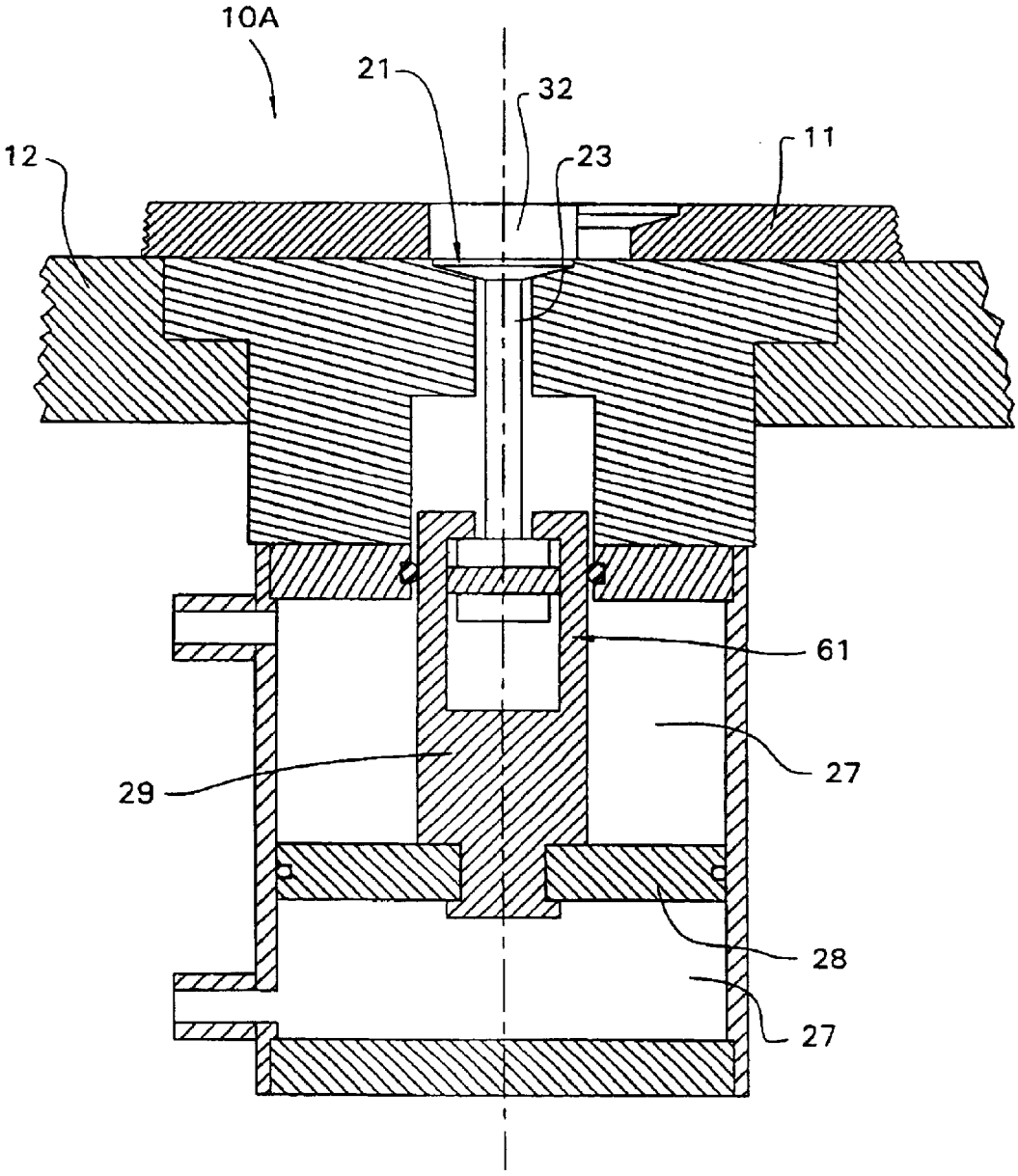
FIGS. 10 and 11 are sectional views of the securing device shown in FIG. 9 but illustrating the device in different operational positions.
Figure 11:
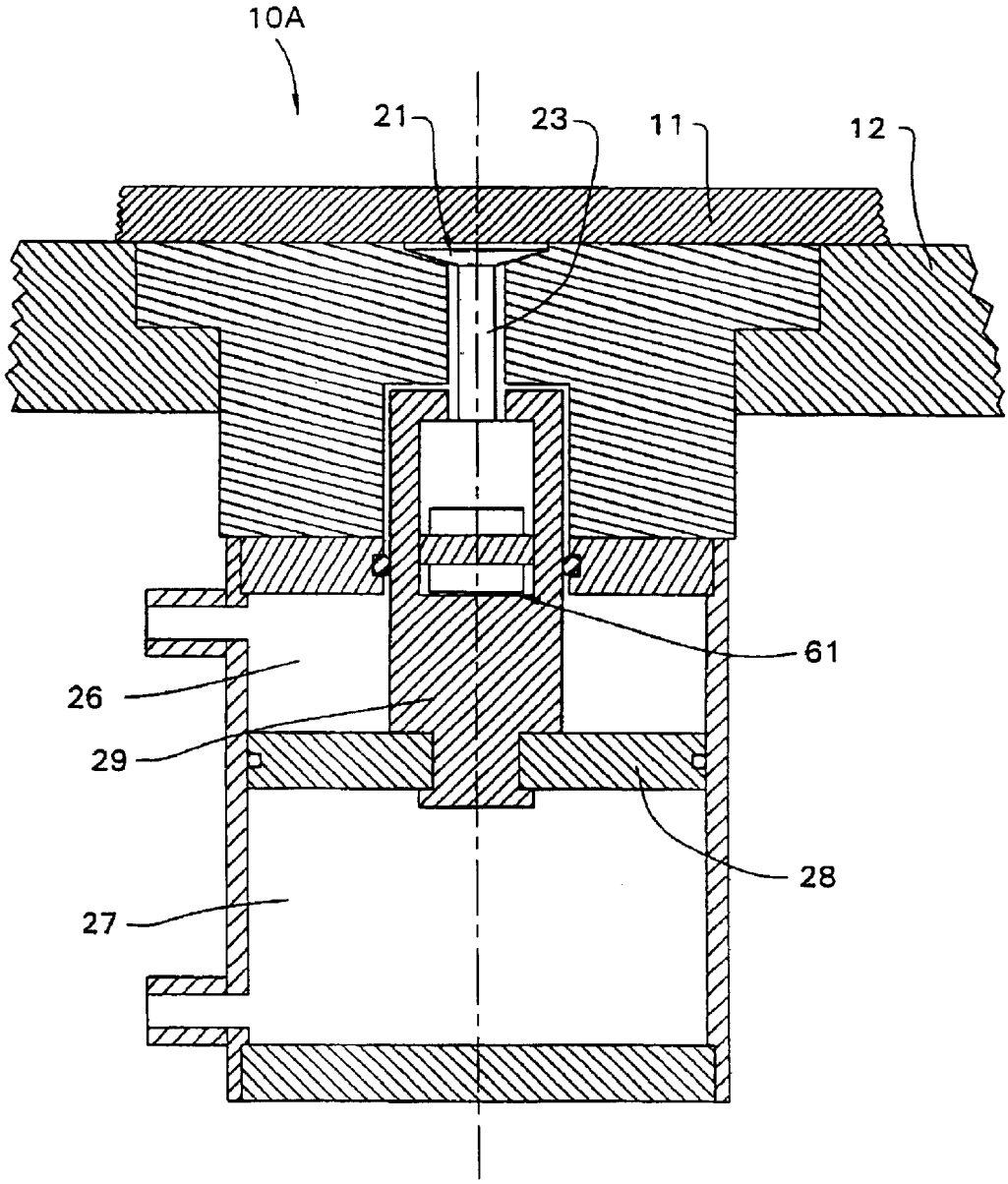

A further embodiment of a securing mechanism 10A according to the present invention is illustrated in FIGS. 9–11, which mechanism generally structurally corresponds to the arrangement illustrated in FIG. 1 so that corresponding parts thereof are identified by the same reference numerals. In the variation of FIGS. 9–11, however, the bolt stem 23 and piston rod 29 are not directly rigidly coupled together as in the FIG. 1 embodiment, but rather are coupled together through a low-force release slip coupling 61 so as to prevent application of a large force against the die cutting board 11 in the event that the clamping bolt is pushed upwardly and abuts the underside of the board as depicted in FIG. 11.

Figure 12:
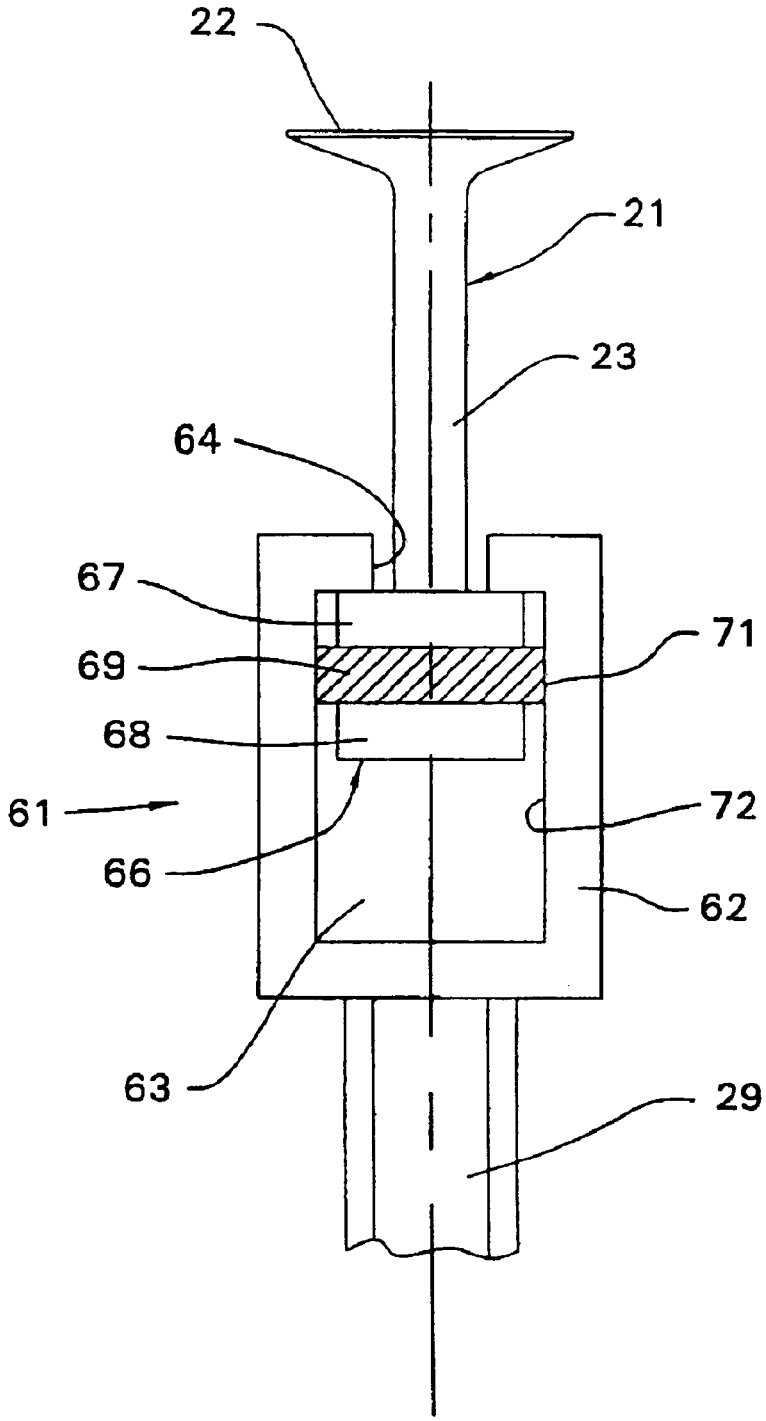
FIG. 12 is an enlarged fragmentary sectional view of the low-force release slip coupling associated with the variation of FIGS. 9–11.

In this variation, and as illustrated in greater detail in FIG. 12, the slip coupling 61 couples directly between the bolt stem 23 and the piston rod 29 so as to permit relative longitudinal displacement of the clamping bolt 21 relative to the piston rod 29 through at least a predefined distance or stroke. For this purpose, the slip coupling 61 includes a head part 62 which is fixed to and defines a part of the piston rod 29. This head part 62 defines therein an enlarged interior chamber 63 which is elongated in the longitudinal or displacement direction of the piston rod. Chamber 63 at its upper or remote end communicates with an opening 64 through which slidably projects the stem 23 of the clamping bolt 21. The clamping bolt stem 23, at its lower end, has a piston arrangement 66 secured thereto and disposed interiorly of the chamber 62 so as to be slidable lengthwise thereof. The piston arrangement 66 in the illustrated embodiment includes opposed clamping plates 67 and 68 which are fixedly mounted on the lower end of the bolt stem and which sandwich an annular slippage control member 69 therebetween, the latter having a surrounding peripheral surface 71 which creates a band of slidable contact with the chamber wall 72.

The slippage control member or collar 69 is formed similar to an annular washer which is disposed in surrounding relationship to the bolt stem, and this member is constructed of a suitable material so as to create a frictional contact with the chamber wall 72 which can be of a low and controlled magnitude. For example, the slip control member 69 can be constructed of a suitable deformable material, such as a flexible polyethylene or polyurethane foam, so that the sliding frictional contact between the collar wall 71 and the chamber wall 72 can be adjusted by varying the degree of axial compression of the collar 69 between the plates 67 and 68. In addition, one of the plates 67–68 can be adjustably mounted on the bolt stem, such as by being threaded thereon, so as to permit the plates 67–68 to be adjustably moved toward or away from one another so as to vary the compression of the collar 69, and hence vary the frictional force between the peripheral surfaces 71–72. The adjustable plate 67–68 can be suitably fixed in position in a conventional manner, such as by a set screw.

With the slip coupling 61 of the present invention, the frictional slippage force of the collar 69 along the wall 72 can hence be controlled to be of very small magnitude such that, so long as the longitudinal force imposed on the clamping bolt does not exceed the slip force, then the bolt and piston rod will move longitudinally as a unit. On the other hand, however, when the longitudinal force on the bolt exceeds the predetermined slip force defined by the slip coupling, then the slip collar 69 will be slidably displaced longitudinally along the chamber wall 72 so as to permit appropriate extension or contraction of the bolt/piston rod assembly, depending upon the direction (i.e., extending or contracting direction) of the longitudinal force.

The operation of the modified securing device 10A illustrated by FIGS. 9–12 will now be briefly described.

When it is desired to mount a die cutting board 11 onto the peripheral wall 12 of a rotary cylinder, the pressure fluid will be supplied to the upper chamber 26 so as to cause the piston rod 29 to be retracted downwardly as illustrated in FIG. 10, thereby causing the clamping bolt 21 to be seated substantially flush with the surface of the cylinder. Thereafter the die cutting board 11 is mounted on the cylinder so that the cylindrical opening 32 associated with aperture 31 is generally aligned with the head of the clamping bolt 21, as illustrated in FIG. 10. The pressure from upper chamber 26 is then exhausted, and pressurized fluid in or supplied to lower chamber 27 then drives the piston rod upwardly and hence cause upward extension of the clamping bolt 21 through the opening 32, substantially as illustrated by FIG. 9. The pressure supplied to the chamber 27 so as to effect extension of the clamping bolt 21 can be generally the same pressure as supplied to the chamber 26 if desired since the extension force in this embodiment of the invention is never applied to the die cutting board, as explained hereinafter. During the upward extension from the retracted position of FIG. 10 to the extended position of FIG. 9, the clamping bolt 21 and piston rod 29 effectively move as a unit, and no significant slippage occurs at the slip joint 61.

After the bolt 21 has been moved into the extended position shown in FIG. 9, then the die cutting board 11 is shifted, generally circumferentially, on the rotary cylinder so that the stem of the bolt moves into the slot 33, following which pressure fluid is exhausted from bottom chamber 27 and is again supplied to upper chamber 26 so as to retract the bolt 21 downwardly so that it lockingly seats within the aperture 31 whereby the upper surface of the bolt head may be substantially flush or slightly recessed relative to the outer surface of the die cutting board 11.

However, if positioning of the die cutting board 11 on the rotary cylinder 13 results in one or more of the securing bolts 21 not aligning with a corresponding cylindrical opening 32, then during the extending stroke due to supplying pressurized fluid to the bottom chamber 27, the clamping bolt head 22 will contact the undersurface of the die cutting board 11 substantially as illustrated in FIG. 11. When such contact occurs, the securing bolt 21 is prevented from moving outwardly (i.e. upwardly in FIG. 11), but at the same time the piston 28 and its rod 29 continue to be driven outwardly by the pressure fluid supplied to bottom chamber 27. Since the force imposed on the piston by the pressure fluid in chamber 27 may significantly exceed the small frictional slip force generated at the annular contact zone between the slip control collar 69 and the surrounding chamber wall 72, the collar 69 axially slips relative to the piston rod 29 as the latter moves upwardly to the position illustrated in FIG. 11. During this continued upward movement of the piston rod, however, the only force applied to the clamping bolt 21 is the small controlled frictional slippage force which exists between the chamber wall 72 and the collar wall 71, whereby the force imposed on the clamping bolt 21 is hence of very small magnitude, which force is incapable of effecting upward lifting or displacement of the die cutting board 11. The bolt 21 in the position illustrated by FIG. 11 is thus generally ineffective with respect to dislodging the board, and effectively remains in an inactive position.

Further, when pressure fluid is exhausted from lower chamber 27 and is resupplied to upper chamber 26 during the next contraction of the securing device 10A, then the downward movement of the piston rod 29 again causes slippage at the slip joint 61 inasmuch as the bolt 21 is not capable of being moved downwardly, whereupon the slip joint 61 allows the piston/bolt assembly to return to its extended position as illustrated in FIG. 10.

With the embodiment illustrated by FIGS. 9–12, only a small and controlled force is imposed against the cutting board tending to dislodge same in the event that the clamping bolt, during an extension operation, is not properly aligned with a clamping aperture. At the same time, however, the driving force utilized for extending the clamping bolt, namely the force generated by the piston 28 and piston rod 29 as a result of pressure fluid supplied to the lower chamber 27, can be of significant magnitude since this driving force is not applied to the underside of the cutting board in the case of a misaligned bolt and aperture.

To release and remove a cutting board 11 from the rotary cylinder, the same steps as described above relative to FIG.

1 are utilized, namely the lower chamber 27 is pressurized to lift the bolt 21 upwardly to disengage the clamping bolt head from the aperture in the cutting board, following which the board is manually shifted so that the bolt head aligns with the opening 32, whereupon the pressure fluid is then supplied to the upper chamber 26 to retract the bolt into the FIG. 10 position, thereby enabling the die cutting board to be removed from the rotary cylinder.

Figure 13:
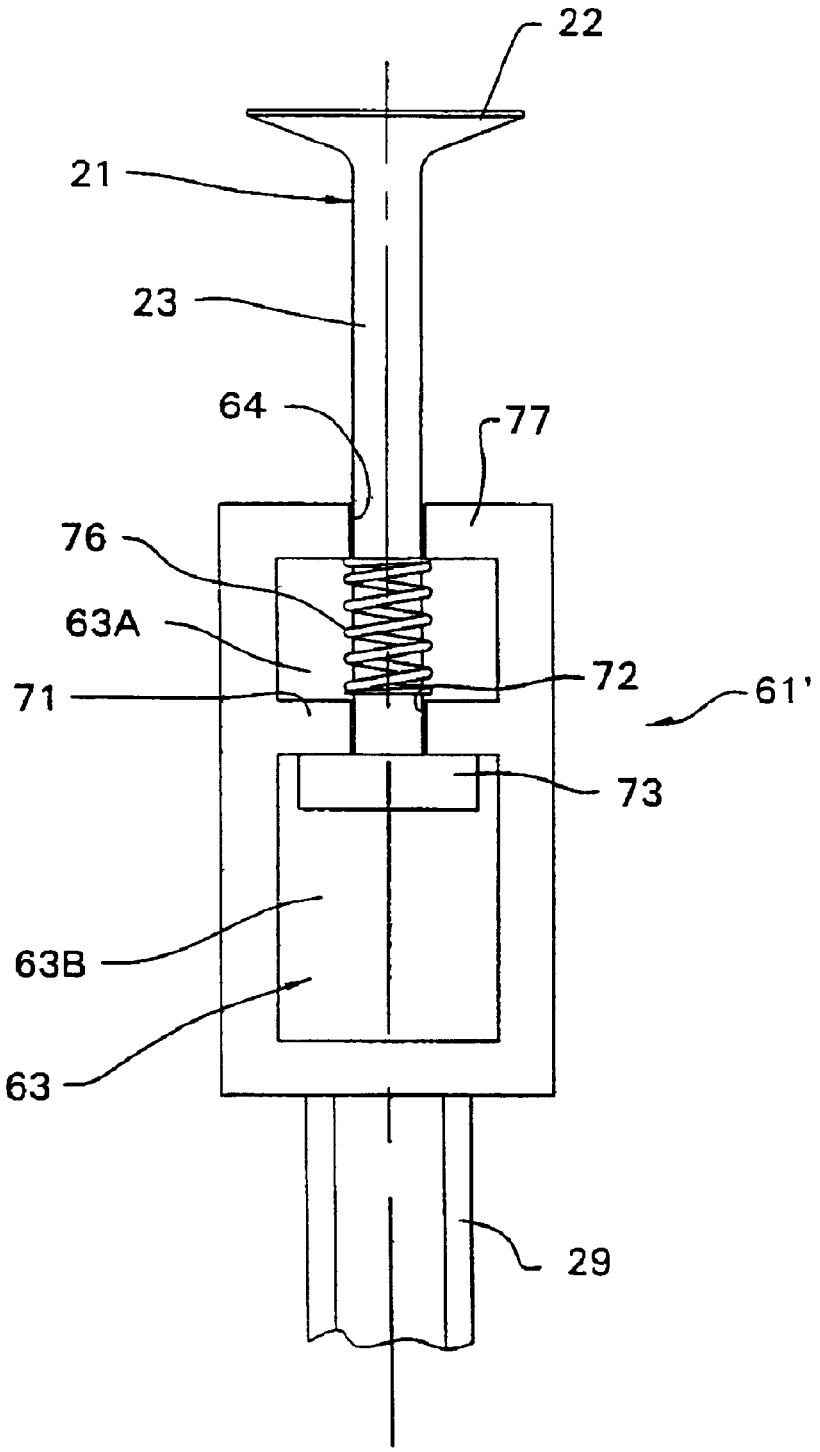
FIG. 13 is an enlarged fragmentary sectional view illustrating a further variation of a low-force release slip coupling.

Referring now to FIG. 13, there is illustrated a modified low-force release slip joint 61' which can be used as a replacement for the slip joint 61 described above. This modified slip joint 61' is incorporated into the overall securing device 10B as illustrated by FIGS. 14–16 which positionally correspond to FIGS. 9–11, respectively.

The modified slip joint 61' again has a chamber 63 defined in the upper end of the piston rod and having an opening 64 communicating therewith and slidably accommodating the bolt stem. The chamber 63 in the illustrated arrangement is divided into upper and lower chamber portions 63A, 63B by an intermediate divider wall 71 which also has an opening 72 therethrough aligned with the opening 64 so as to permit a lower portion of the bolt stem to slidably project therethrough into the lower chamber 63B. The lower end of the bolt stem has an enlarged part 73 secured thereto and disposed in the lower chamber for limiting the upward extension of the bolt 21 relative to the piston rod 29 while preventing longitudinal separation therebetween.

To provide for a controlled low-force longitudinal release or movement between the bolt 21 and the piston rod 29, a force control member 76 formed generally as a multi-coil compression spring is disposed in surrounding relationship to the stem 23 and is positioned within the upper chamber portion 63A, with this control spring 76 being restricted or confined between the divider wall 71 and the top wall 77. The coil spring 76 is sized so that, when in a noncompressed condition (that is, the spring is substantially free of longitudinal compression force thereon), the inside diameter of the spring coils will be in frictional contact with the exterior wall of the bolt stem 23 so as to create a frictional holding force between the spring and the bolt stem. The contact between the spring 76 and the bolt stem 23 will preferably be a small interference fit. In addition, the overall length of the coil spring 76 in the noncompressed condition will preferably be no greater than the vertical spacing between the divider wall 71 and the top wall 77, and in fact the overall noncompressed length of the compression spring 76 will typically be slightly less than the distance between these opposed walls.

Figure 14:
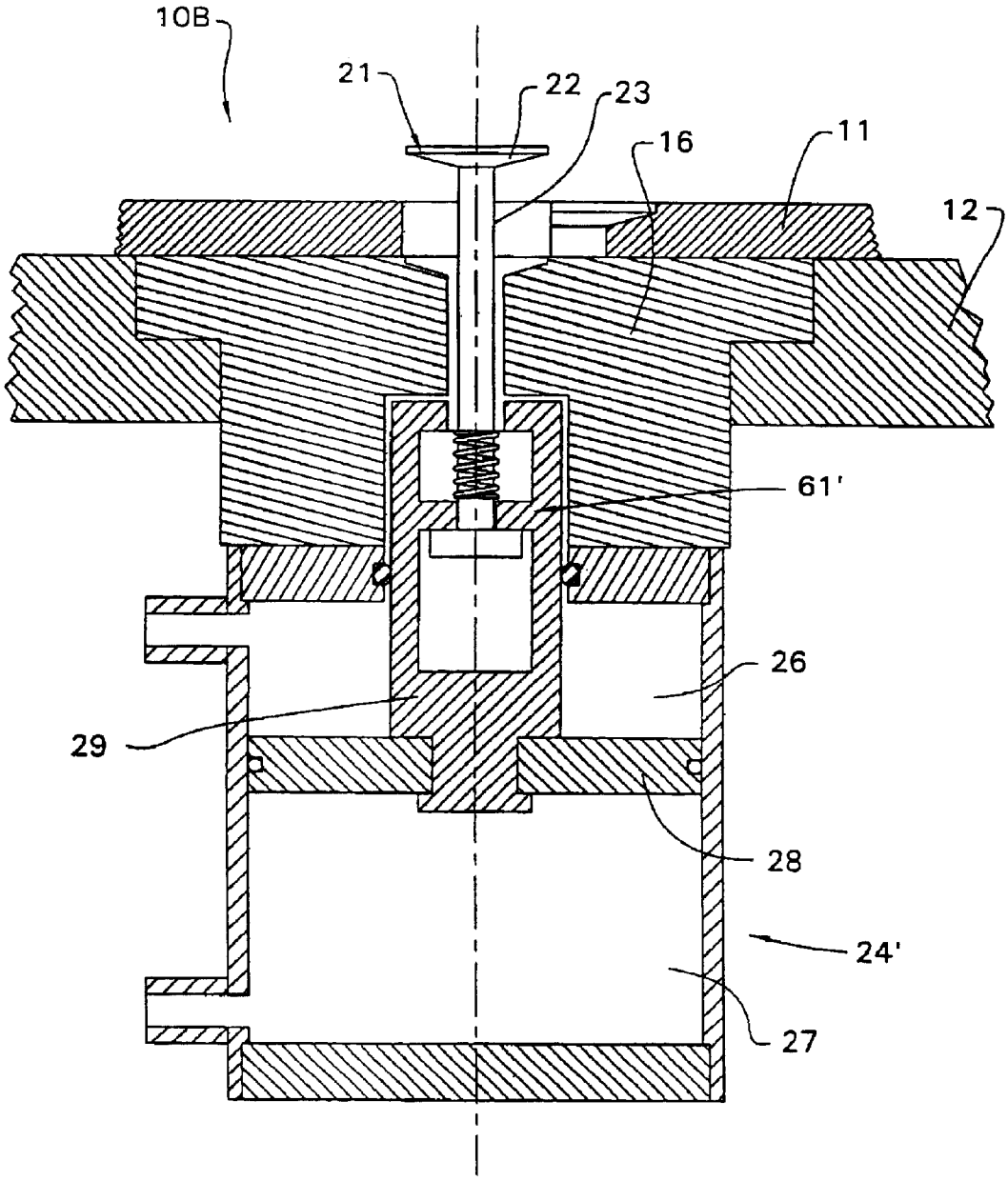
FIG. 14 is a fragmentary sectional view showing a still further variation of a securing device according to the present invention, which device incorporates therein the slip coupling illustrated in FIG. 13.
Figure 15:
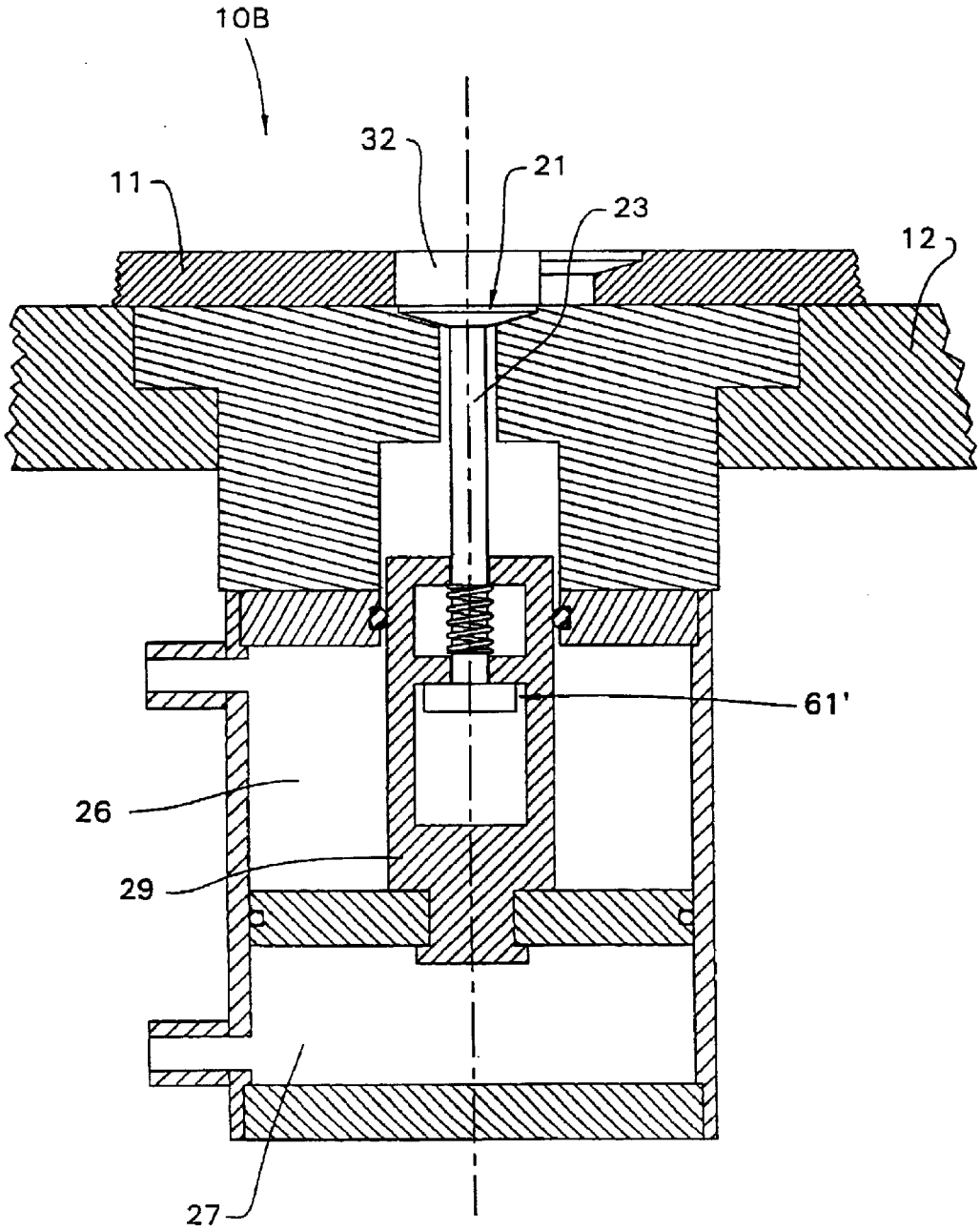
FIGS. 15 and 16 are sectional views which illustrate the variation of FIG. 14 in different operational positions.
Figure 16:
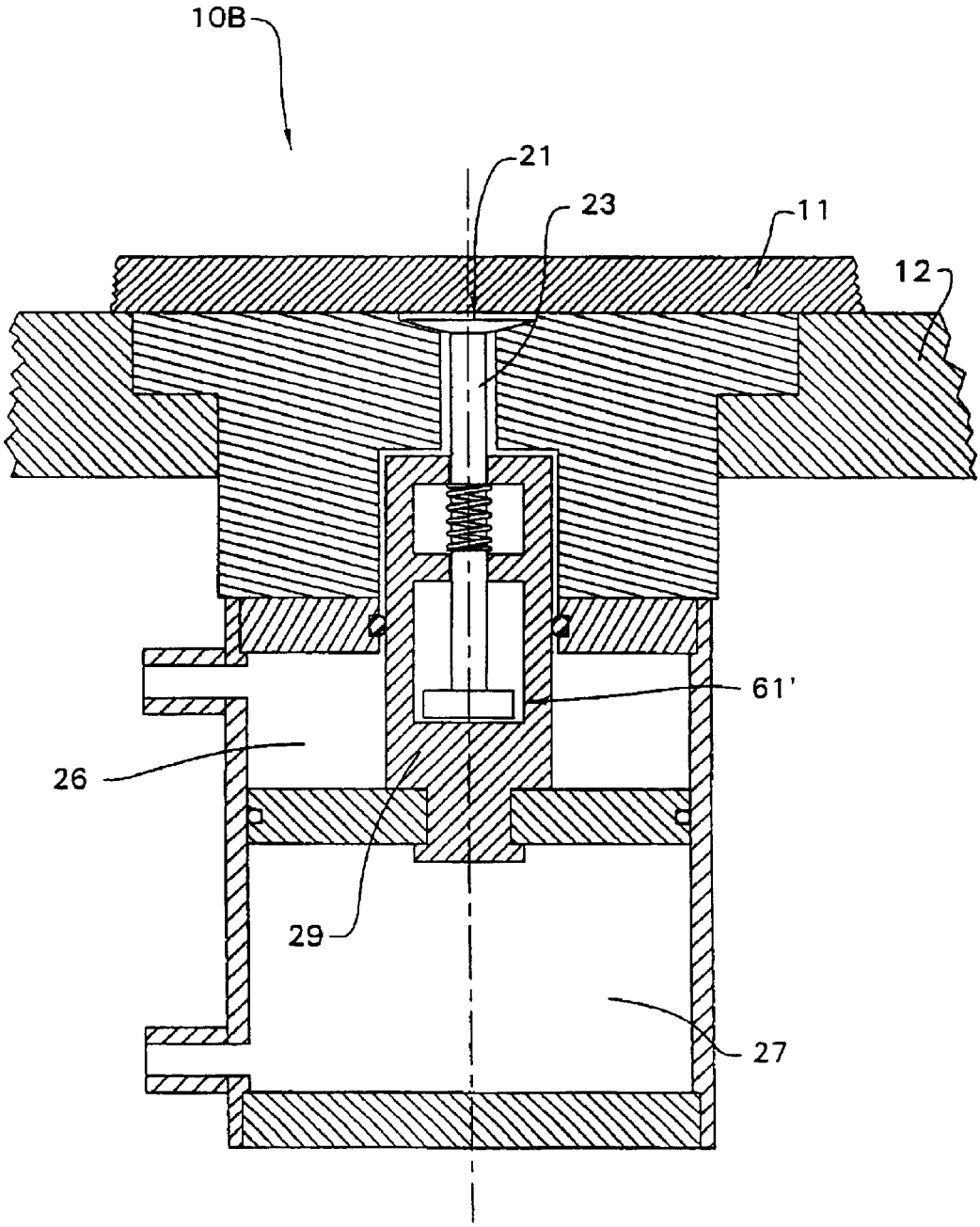

With the slip joint 61' incorporated into the securing device 10B as illustrated in FIGS. 14–16, the clamping bolt/piston rod assembly will normally be maintained in its extended position wherein the confining head 73 on the inner lower end of the bolt 21 effectively abuts against the divider wall 71, whereby the securing device operates in the normal manner as described above relative to FIGS. 9–10 and as illustrated by corresponding FIGS. 14–15.

However, when the bolt/piston rod assembly is moved upwardly so as to effect outward extension of the bolt 21, but the bolt 21 does not align with an aperture 32 in the plate 11 so as to contact the underside of the plate as illustrated by FIG. 16, then in such situation the piston rod 29 continues to move upwardly but the bolt 21 remains stationary and hence slips or downwardly contracts into the piston rod. During this slippage, the initial upward displacement of the piston rod 29 causes the divider wall 71 to contact the lower end of the coil spring 76 and effect imposition of an upwardly directed longitudinal compression force thereagainst. This compression force causes some of the individual coils adjacent at least the lower end of the spring to slightly circumferentially expand so as to reduce and in some cases move out of gripping contact with the bolt stem 23, thereby reducing the magnitude of the gripping force between the coil spring 76 and the bolt stem 23. The gripping force between the coil spring and the stem hence reduces to a sufficiently low magnitude so as to enable the piston rod 29 to slide upwardly and at the same time effect upward sliding of the spring 76 along the bolt stem into the position substantially as illustrated in FIG. 16, with the upward sliding of the spring along the bolt stem causing only a small upward force to be imposed on the bolt 21, which upward force is limited by the small frictional gripping force between the bolt stem 23 and the coils of the spring 76. In this manner the force imposed against the underside of the die cutting board 11 is maintained very small, even though a significantly larger upward driving force may be generated by the piston and piston rod.

During the downward contraction of the piston rod 29 from the position illustrated in FIG. 16, a reverse operation occurs in that the top wall 77 of the piston rod engages the upper end of the coil spring 76 and imposes a downward compression force thereon, causing at least some of the upper coils to expand and hence reduce the frictional gripping force between the coil and the bolt stem, whereupon the spring slides downwardly along the stem during the retraction of the piston rod so that the overall mechanism again resumes a position substantially as illustrated in FIG. 15.

While the embodiment of FIGS. 13–16 discloses the use of a coiled compression spring as the slipping force-control member, it will be appreciated that other types of springs can be utilized. For example a spring clip disposed in surrounding and engaged relationship with the bolt stem, and creating an engaged cooperative relationship between the piston rod and the bolt stem, can be provided so as to function in a manner generally similar to the coiled spring as described above.

The variations illustrated by FIGS. 9–16 all enable the main driving force for extension of the clamping bolt, as controlled by the pressure fluid supplied to the lower pressure chamber 27, to be of significantly larger magnitude inasmuch as this extension force is not applied directly to the clamping bolt during extension thereof due to the provision of the slip coupling 61 or 61' provided between the clamping bolt and the piston rod. This hence enables the upward extension force associated with the driving arrangement to be significantly greater, in comparison to the upward extension force associated with the embodiments depicted in FIGS. 1 and 7, whereby overall control of the upward driving force is hence less sensitive and accordingly has less impact on overall satisfactory performance of the securing mechanism.

While the embodiments of FIGS. 9–16 both disclose a double-acting pressure cylinder as the main driving device for causing both extension and contraction of the securing bolt, it will be appreciated that other driving or biasing devices can be utilized. For example, the double-acting pressure cylinder could be replaced with a single-acting pressure cylinder coupled with a spring drive so that the spring functions to drive the piston rod in one direction, and the pressure chamber associated with the piston functions to drive the piston rod in the opposite direction in opposition to the spring force. The spring, in this situation, typically will be used to control retraction of the clamping bolt.

In the embodiments of the invention, the use of a pressure cylinder as a driving device provides an advantageous constant output force during the clamping stroke, this being more important during bolt extension, and hence eliminates the problems associated with a variable driving force such as exists when springs are used as the driving device.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A cutting machine having a rotary support cylinder, a cutting die board removably attached to said cylinder, and a clamping mechanism mounted on the rotary support cylinder for securing the cutting die board to the periphery of the cylinder, said clamping mechanism comprising:

an elongate clamping bolt supported for movement in the longitudinal direction thereof, the bolt having an enlarged head at one end thereof adapted to project through a clearance opening formed in the cutting die board;

a two-way activating device connected to the clamping bolt for effecting longitudinal movement thereof in an extending direction toward an extended disengaged position wherein the head of the clamping bolt is disposed outwardly of the rotary cylinder and in a retracting direction toward a retracted position wherein the head of the clamping bolt is positioned within the rotary cylinder or an intermediate engaged position for engaging and holding the cutting die board on the cylinder;

said activating device including first and second fluid-pressure biasing arrangements cooperating with and acting oppositely on a longitudinally movable activating member for urging the clamping bolt toward the extended and retracted positions respectively;

a control for selectively activating at least one of said biasing arrangements only when movement of said clamping bolt toward the respective position is desired; and a low-force releasable slip coupling connected between said clamping bolt and said activating member and permitting relative longitudinal movement therebetween when the longitudinal force applied to the slip coupling when the bolt is moving in the extending direction exceeds a defined force of small magnitude.

2. A machine according to claim 1, wherein said first biasing arrangement comprises a pressure fluid chamber defined on one side by a moving piston which is coupled to said activating member to effect movement thereof in the extending direction upon pressurization of said pressure fluid chamber, and said second biasing arrangement comprises a second pressure fluid chamber defined on the opposite side of said moving piston to effect movement of said activating member in the retracting direction upon pressurization of said second chamber.

3. A machine according to claim 2, wherein the force applied to the activating member by said first biasing arrangement during the extending movement can be greater than said defined force so that the slip coupling allows the clamping bolt to longitudinally slip relative to the activating member if the clamping bolt encounters an opposed resistance which exceeds said defined force.

4. A cutting machine having a rotary support cylinder, a cutting die board removably attached to said cylinder, and a clamping mechanism mounted on the rotary support cylinder for securing the cutting die board to the periphery of the cylinder, said clamping mechanism comprising:

an elongate clamping bolt supported for movement in the longitudinal direction thereof, the bolt having an enlarged head at one end thereof adapted to project through a clearance opening formed in the cutting die board;

a two-way activating device connected to the clamping bolt for effecting longitudinal movement thereof in an extending direction toward an extended disengaged position wherein the head of the clamping bolt is disposed outwardly of the rotary cylinder and in a retracting direction toward a retracted position wherein the head of the clamping bolt is positioned within the rotary cylinder or an intermediate engaged position for engaging and holding the cutting die board on the cylinder;

said activating device including first and second biasing arrangements cooperating with a longitudinally movable activating member for urging the clamping bolt toward the extended and retracted positions respectively;

a control for selectively activating at least one of said biasing arrangements only when movement of said clamping bolt toward the respective position is desired; and a low-force releasable slip coupling connected between said clamping bolt and said activating member and permitting relative longitudinal movement therebetween when a longitudinal force applied to the slip coupling when the bolt is moving in the extending direction exceeds a defined force of small magnitude, said slip coupling including a coupling member having a frictional surface of engagement with one of said activating member and said clamping bolt, said surface of engagement defining a longitudinally slippable frictional contact which creates said defined force in the longitudinal direction, said coupling member also having a surface for reactive engagement with the other of the activating member and clamping bolt, whereby the clamping bolt and activating member are coupled together and move as a unit so long as the longitudinal force reacting therebetween does not exceed said defined force, and whereby the coupling member moves longitudinally relative to said one of said activating member and said clamping bolt due to slippage at said surface of engagement due to said longitudinal force exceeding said defined force.

5. A machine according to claim 4, wherein said coupling member comprises a friction member of a partially deformable material having a peripheral surface disposed in slidable frictional contact with the activating member.

6. A machine according to claim 4, wherein the coupling member comprises a spring disposed in surrounding relationship to a stem of the clamping bolt and having a frictional contact engagement with an exterior peripheral surface of the stem.

7. A machine according to claim 6, wherein said spring is a compression-type coil spring.

8. A machine according to claim 4, wherein said first biasing arrangement comprises a pressure fluid chamber defined on one side by a moving piston which is coupled to said activating member to effect movement thereof in the extending direction upon pressurization of said pressure fluid chamber.

9. A machine according to claim 8, wherein said second biasing arrangement comprises a second pressure fluid chamber defined on the opposite side of said moving piston to effect movement of said activating member in the retracting direction upon pressurization of said second chamber.

10. A rotary die apparatus for cutting material such as corrugated cardboard, said apparatus comprising a rotary support cylinder, a cutting die board for releasable attachment to a peripheral surface of the rotary cylinder, the die board having an opening therethrough for permitting securement to the periphery of the rotary cylinder, and a clamping mechanism mounted on the rotary cylinder for permitting removable but fixed securement of the die board to the periphery of the cylinder;

said clamping mechanism comprising a double-acting pressure cylinder having a cylinder housing fixed to the rotary support cylinder and having a fluid pressure activated piston movably disposed therein, a piston rod coupled to the cylinder and projecting radially outwardly relative to the rotary support cylinder, and a clamping bolt coupled to the piston rod and projecting away therefrom generally in the radial direction of the rotary support cylinder, the clamping bolt having an enlarged head at a remote outer end thereof;

the double-acting pressure cylinder defining first and second pressure chambers disposed on opposite sides of the piston so that supplying pressure fluid to the first chamber effects movement of the piston rod and clamping bolt radially outwardly relative to the rotary support cylinder into an extended position wherein the head of the bolt is spaced radially outwardly away from the peripheral surface of the rotary cylinder to permit positioning of the die board on the peripheral surface of the rotary support cylinder, the supplying of pressure fluid to said second chamber causes the piston rod and clamping bolt to be moved radially inwardly in a retracting direction either into an intermediate position wherein the head of the bolt clampingly engages the cutting board if present or inwardly into a retracted position wherein the head of the bolt is disposed so as to not project outwardly beyond the peripheral surface of the rotary support cylinder; and a low-force releasable slip coupling connected between said clamping bolt and said piston rod and permitting relative longitudinal movement therebetween when the force applied to the piston in the extending direction exceeds a slip force defined by the slip coupling such as due to the head of the clamping bolt contacting and being prevented from moving radially outwardly by the cutting die board.

* * * * *